US010183297B2

(12) United States Patent
Jonkka

(10) Patent No.: US 10,183,297 B2
(45) Date of Patent: Jan. 22, 2019

(54) METHOD AND APPARATUS FOR REDUCING GIVE IN A CRUSHER

(71) Applicant: Metso Minerals, Inc., Helsinki (FI)

(72) Inventor: Jari Jonkka, Kangasala (FI)

(73) Assignee: Metso Minerals, Inc., Helsinki (FI)

( * ) Notice: Subject to any disclaimer, the term of this patent is extended or adjusted under 35 U.S.C. 154(b) by 946 days.

(21) Appl. No.: 14/419,666

(22) PCT Filed: Aug. 20, 2013

(86) PCT No.: PCT/FI2013/050812
§ 371 (c)(1),
(2) Date: Feb. 5, 2015

(87) PCT Pub. No.: WO2014/029914
PCT Pub. Date: Feb. 27, 2014

(65) Prior Publication Data

US 2015/0224508 A1 Aug. 13, 2015

(30) Foreign Application Priority Data

Aug. 24, 2012 (FI) ..... 20125877

(51) Int. Cl.
*B02C 1/00* (2006.01)
*B02C 1/02* (2006.01)
*F04B 7/02* (2006.01)

(52) U.S. Cl.
CPC ..... *B02C 1/025* (2013.01); *F04B 7/02* (2013.01)

(58) Field of Classification Search
CPC ..... B02C 2/025; B02C 2/02; F04B 7/02
(Continued)

(56) References Cited

U.S. PATENT DOCUMENTS 3,918,648 A * 11/1975 Anthony ..... B02C 1/025 241/268
4,765,546 A * 8/1988 Stewart ..... B02C 1/005 241/266

(Continued)

FOREIGN PATENT DOCUMENTS

DE 1 237 414 B 3/1967
DE 1 237 882 B 3/1967

(Continued)

OTHER PUBLICATIONS

Telsmith, Inc., "2550 (C250) Jaw Crusher Operation and Maintenance," Apr. 2009, 126 pages.

(Continued)

*Primary Examiner* — Faye Francis
(74) *Attorney, Agent, or Firm* — Andrus Intellectual Property Law, LLP

(57) ABSTRACT

A crusher for crushing mineral material, a method for decreasing give in a crusher and a mineral material processing plant. The crusher includes a movable and a fixed crushing element arranged to receive a force. The crusher further includes a hydraulic cylinder and a piston inside the hydraulic cylinder and a piston rod attached to the piston which extends through a first end of the hydraulic cylinder and is connected to the movable crushing element. The hydraulic cylinder has a first space around the part of the piston rod in the hydraulic cylinder and a second space limited by the first space and the piston. The crusher further includes a valve and a hydraulic fluid connection from the valve to the first space. The valve is configured to enable a flow of hydraulic fluid into the first space in response only to the piston moving in the hydraulic cylinder towards the second space due to said force.

11 Claims, 6 Drawing Sheets

(58) Field of Classification Search
USPC ..... 241/266
See application file for complete search history.

(56) References Cited

U.S. PATENT DOCUMENTS

| | | | | |
|---|---|---|---|---|
| 6,375,105 | B1 | 4/2002 | Haven et al. | |
| 6,827,301 | B1 | 12/2004 | Kassuba | |
| 7,341,213 | B2 * | 3/2008 | Boast | B02C 1/025 241/264 |
| 7,942,355 | B2 * | 5/2011 | Yamazaki | B02C 1/025 241/101.2 |
| 8,322,643 | B2 * | 12/2012 | Gervais | B02C 1/10 241/101.742 |
| 2012/0018558 | A1 * | 1/2012 | Gervais | B02C 1/04 241/101.74 |

FOREIGN PATENT DOCUMENTS

| | | | |
|---|---|---|---|
| DE | 1 276 422 | B | 8/1968 |
| EP | 2 662 142 | A1 | 11/2013 |

OTHER PUBLICATIONS

PCT International Search Report dated Feb. 24, 2014.
PCT Written Opinion.
Finnish Office Action dated Jun. 13, 2013.
Finnish Application No. 20095429, Metso Minerals Inc., filed Mar. 11, 2010.
Machine English translation of DE 1237414.
Machine English translation of DE 1237882.
Machine English translation of DE 1276422.

* cited by examiner

METHOD AND APPARATUS FOR REDUCING GIVE IN A CRUSHER

CROSS-REFERENCE TO RELATED APPLICATIONS

This application claims priority to PCT/FI2013/050812, filed. Aug. 20, 2013, and published in English on Feb. 27, 2014 as publication number WO 2014/029914, which claims priority to FI Application No. 20125877, filed Aug. 24, 2012, incorporated herein by reference.

FIELD OF INVENTION

The invention relates generally to reducing give of a piston of a hydraulic cylinder in a mineral material processing plant. Particularly, but not exclusively, the invention relates to reducing give of a piston of a hydraulic cylinder in a crusher of mineral material. Particularly, but not exclusively, the invention relates to reducing give of jaws of a jaw crusher during operation thereof caused by crushing forces.

BACKGROUND

A jaw crusher is a device suitable for crushing stone. FIG. 1 shows a known jaw crusher 100 at maximum setting and FIG. 2 shows the jaw crusher of FIG. 1 at minimum setting. A jaw crusher comprises two crushing elements i.e. jaws 10 that are arranged to receive the forces generated during operation of the crusher or for example while changing the setting of the crushing elements. One crushing element is a substantially immobile fixed jaw supported on a frame 4, and the other crushing element is a jaw attached to a pendulum and configured to be movable. The crusher further comprises a pendulum 11 attached through a bearing from the top end thereof to an eccentric 12 causing the top end of the pendulum 11 to rotate around the centre axis of the eccentric. A toggle plate 1 functioning as a linkage for the pendulum is situated between the bottom end of the pendulum and the back end of the jaw crusher. The toggle plate and the linkage provide for the desired kinematics of the crusher in order to achieve effective crushing. The toggle plate is attached at one end with separate connecting elements to the pendulum and at the other end to the piston rod of a hydraulic cylinder 9 functioning as a safety apparatus in such a way that the piston rod is in connection with the crushing element configured to be movable. Both ends of the toggle plate 1 comprise connection elements 3 that comprise toggle plate bearings between the pitman 1 and the connecting elements 3. The upper connecting element is fitted between the guide elements 6 in such a way that during the crusher setting adjustment or during an overload situation, the connecting element can glide along the guide elements towards the hydraulic cylinder while the piston is pressed further into the cylinder. The piston of the hydraulic cylinder of the safety apparatus supports the movable jaw from the outer side.

If the force or strain incident on the movable jaw is too large, the toggle plate may give in, i.e. a so called buckling takes place, and thus protect the crusher from further damage. In addition to the toggle plate, the hydraulic cylinder and a safety valve form a further safety apparatus, since the space 16 behind the piston has a connection through the safety valve to a hydraulic fluid tank.

The crusher according to FIGS. 1 and 2 further comprises a return cylinder 2 which is a double acting cylinder. The return cylinder is attached to the crusher frame for example at a bracket next to the cylinder 9 of the safety apparatus. The return cylinder is connected to a hydraulic accumulator 15 that holds the piston rod side of the return cylinder pressurized during operation in order to ensure tension. The return cylinder 2 is also utilized in enlarging the setting, since the cylinder of the safety apparatus is single acting.

FIG. 3 shows a system 300 that demonstrates the functioning of the hydraulic cylinder 9 of the safety apparatus. The hydraulic cylinder 9 has a piston 316 dividing the volume of the cylinder into a pressure space 312 and opposite space 314, i.e. the piston rod side space. The piston rod 318 receives the load or force incident on the piston from the toggle plate. The load causes a pressure equivalent to the amount of force divided by the cross-sectional area of the cylinder into the pressure space. As the pressure exceeds a given pressure threshold, a pressure relief valve PRV 360 connected to the pressure space 312 allows hydraulic fluid from the pressure space to a hydraulic fluid tank 320 whereupon the toggle plate and the movable jaw are allowed to give before the excessive load. This is beneficial for example if uncrushable material such as steel or the like ends up between the jaws. The piston 316 is driven back to its desired position by pumping hydraulic fluid into the pressure space 312 with a pump 330. A valve 340 is used to control the filling of the pressure space 312 in such a way as to steer the piston to its desired position.

The crushing elements, the pendulum and the cylinder of the safety apparatus of the jaw crusher receive large crushing forces during crushing and move several times per second. The required wear resistance is taken into account in the structure of the jaw crusher by using sufficiently large material strengths and wear resistant surfaces in such a way that on one hand a sufficient durability is reached and on the other hand creating costs is avoided. In addition, the crushing capacity of the jaw crusher that is dependent on the efficiency of the crushing impacts is sought to be maximized and the energy consumption of the crusher is sought to be minimized.

Patent publication FI20095429 (A) shows an arrangement with which undesired give of a cylinder can be reduced in order to increase the efficiency of a crusher.

The purpose of the invention is to avoid or lessen problems related to the state of the art and/or provide new technical alternatives.

SUMMARY

The inventor has noted that compression of the hydraulic fluid of a cylinder of a safety apparatus of a jaw crusher allows a large movement during load impulses formed during crushing impacts, and that this repeated strain substantially exposes the inclined joints between the cylinder and the pendulum to wear. The inventor has further noted that the undesired give decreases the efficiency of the crusher, as it decreases the power of the crushing impacts. The inventor has further noted that in the state of the art the undesired give is sought to be reduced with complicated technical arrangements thus increasing costs and decreasing operational reliability.

According to a first example aspect of the invention there is provided a crusher for crushing mineral material comprising a substantially fixed crushing element and a crushing element configured to be movable, which crushing elements are arranged to receive a force, the crusher further comprising:

a hydraulic cylinder and a piston in the hydraulic cylinder;

a piston rod (318) attached to the piston and extending through a first end of the hydraulic cylinder and being in connection with the crushing element configured to be movable;

a first space inside the hydraulic cylinder around the part of said piston rod inside the hydraulic cylinder;

a second space defined by the hydraulic cylinder and the piston that the first space and the piston limit from the hydraulic cylinder;

a valve;

a first hydraulic connection from said valve to said first space; in which crusher said valve is configured to enable a flow of hydraulic fluid into said first space in response only to the piston moving in the hydraulic cylinder towards said second space due to said force.

Preferably the valve is configured to prevent a flow of hydraulic fluid from said first space in response only to the piston trying to move in the hydraulic cylinder towards said first space.

Preferably the crusher comprises a pressure relief valve in a hydraulic connection to said second space through a second hydraulic connection.

Preferably the pressure relief valve is configured to enable a flow of hydraulic fluid from said second space in response to the pressure of the second space reaching a predetermined pressure.

Preferably the crusher is a jaw crusher or an HSI-crusher.

According to a second aspect of the invention there is provided a mineral material processing plant that comprises a crusher according to the first aspect of the invention.

Preferably the mineral material processing plant is a mobile processing plant.

According to a third aspect of the invention there is provided amethod for reducing give in a crusher, said crusher comprising a substantially fixed crushing element and a crushing element configured to be movable, which crushing elements are arranged to receive a force, the method comprising:

supporting the crushing element configured to be movable with an apparatus comprising a hydraulic cylinder, a piston, a piston rod, and hydraulic fluid, wherein hydraulic fluid is directed behind the piston on the piston rod side in response only to the piston moving pushed by the piston rod in the hydraulic cylinder due to said force.

Preferably the hydraulic fluid is directed behind the piston on the piston rod side through a valve.

Preferably that the hydraulic fluid is prevented from exiting behind the piston on the piston rod side in response only to the piston trying to move backwards by being pushed by the pressure in front of the piston in the hydraulic cylinder.

Preferably hydraulic fluid is removed from front of the piston through a pressure relief valve in response to the pressure in front of the piston reaching a predetermined pressure.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
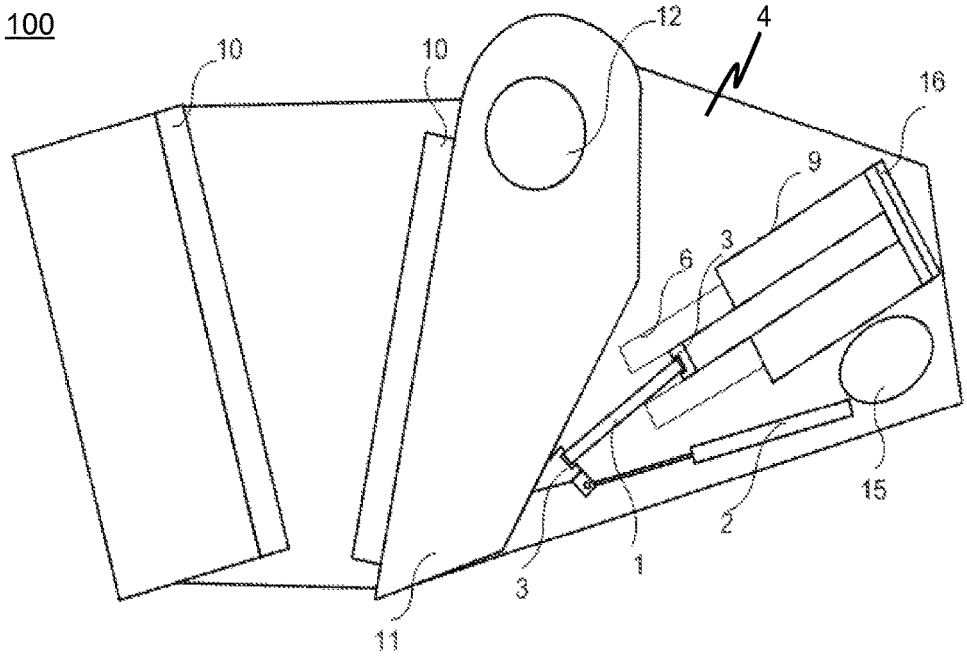
FIG. 1 shows a side-view of a known jaw crusher at minimum setting.
Figure 2:
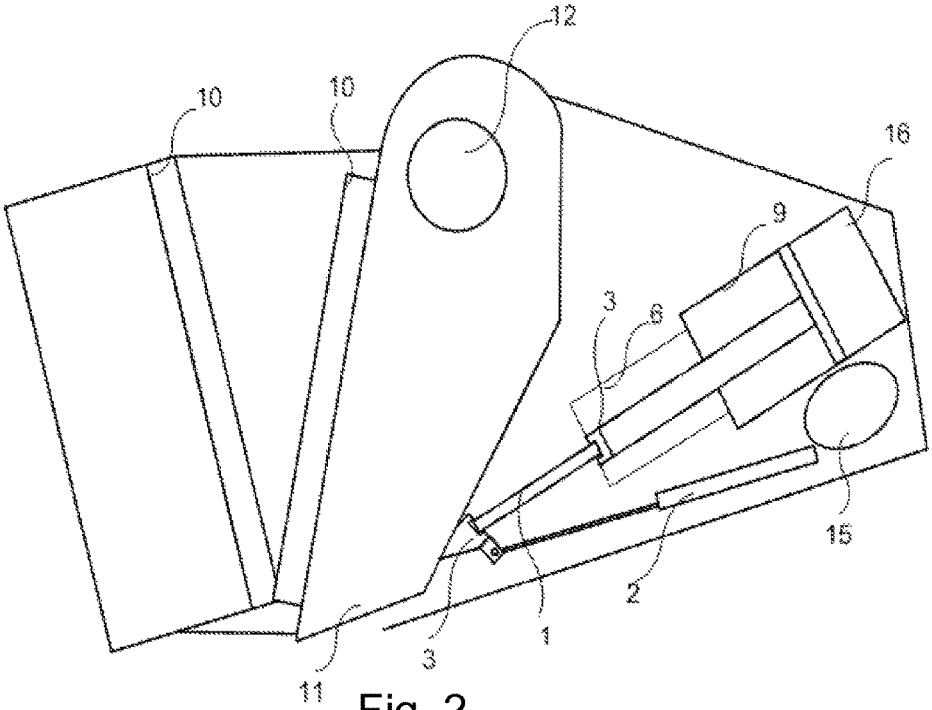
FIG. 2 shows a side-view of the jaw crusher of FIG. 1 at minimum setting.
Figure 3:
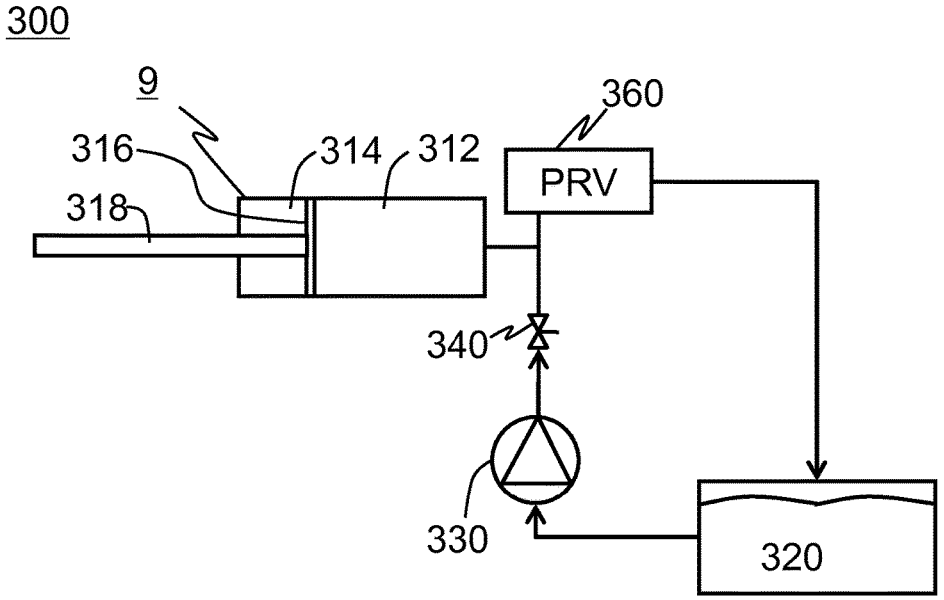
FIG. 3 shows a schematic representation of the hydraulic safety apparatus of the jaw crusher of FIG. 1.

FIGS. 1-3 have been explained in connection with the background of the invention. A jaw crusher according to FIGS. 1-2 can be used as an environment of different embodiments of the present invention in such a way that instead of the safety apparatus of FIGS. 1 and 2 an apparatus according to an embodiment of the invention is used. With the help of different embodiments of the invention the crusher can be scaled for reduced wear, as the give of the safety apparatus can be reduced compared to previous solutions.

Figure 4:
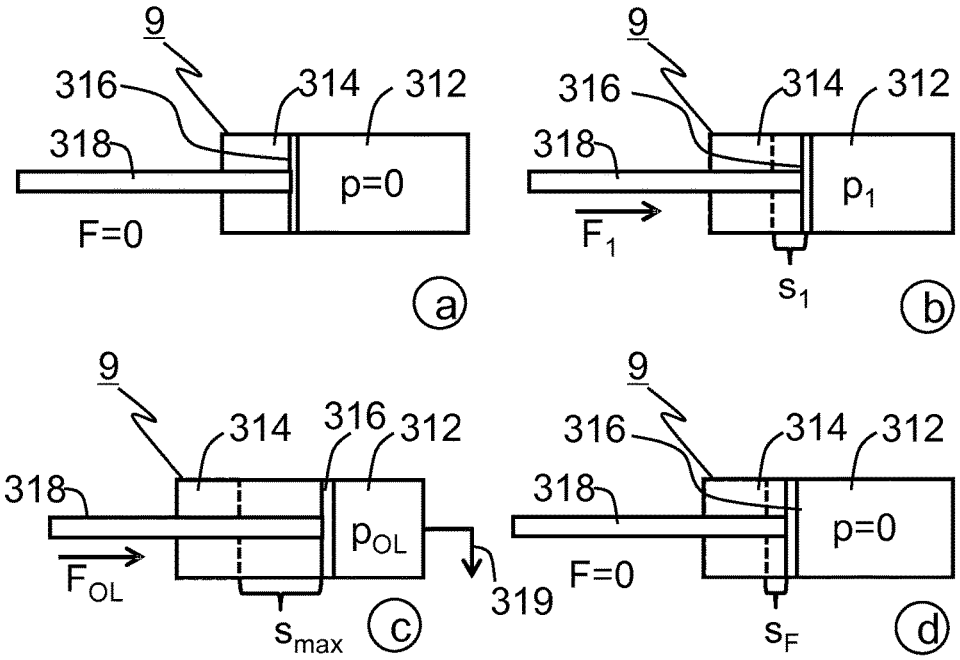
FIG. 4 shows schematically the principle of the functioning of the piston of the hydraulic safety apparatus during working stroke (phases a-d) and in an overload situation.
Figure 5:
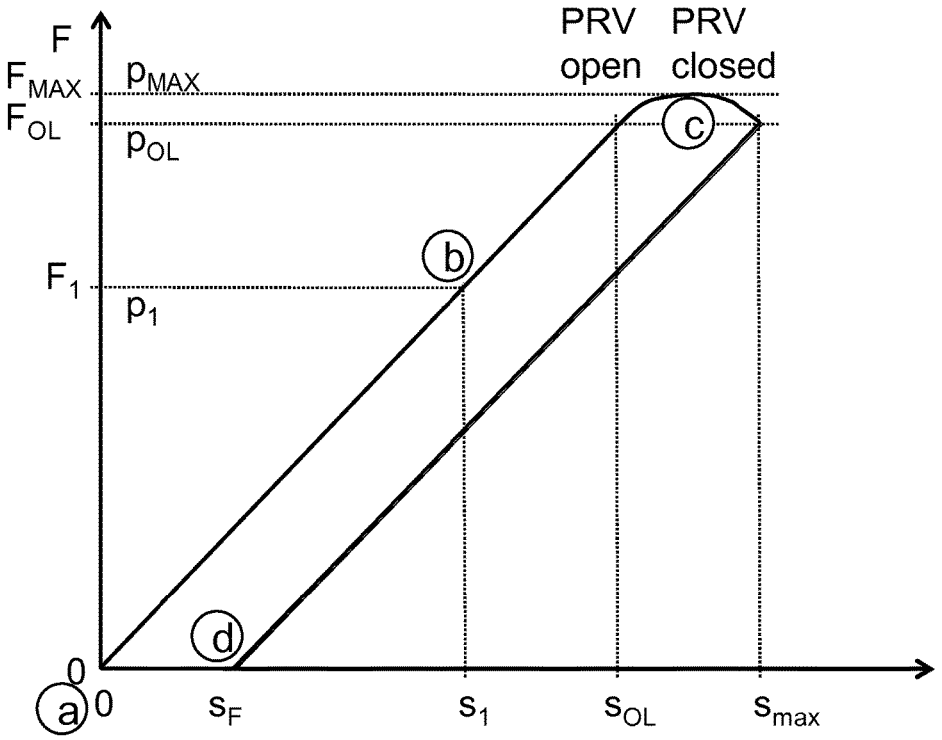
FIG. 5 shows the pressure of the hydraulic fluid supporting the piston of the safety apparatus of FIG. 3 and the force caused by the pressure as a function of the position of the piston during working stroke (phases a-d) and in an overload situation.

FIG. 4 shows schematically the principle of the functioning of the piston of the hydraulic safety apparatus during working stroke (phases a-d) and in an overload situation. FIG. 5 shows the pressure of the hydraulic fluid supporting the piston of the safety apparatus of FIG. 3 and the force caused by the pressure as a function of the position of the piston during working stroke (phases a-d) and in an overload situation.

At the beginning of each working stroke of the jaws of the crusher, or like wear elements, at phase a the pressure in the pressure space 312 of the cylinder 9 is zero, since no crushing force is incident on the cylinder. During the working stroke at phase b the pressure in the cylinder rises to pressure $p_1$ that is dependent on the force $F_1$ received by the crushing elements and incident on the cylinder and on the cross-sectional area of the piston 316 of the cylinder 9. Concurrently the piston 316 being pressed by the piston rod advances a distance $s_1$ due to compression of the hydraulic fluid. The advancement of the piston causes an undesired give of the jaw of the jaw crusher that decreases the power of the working stroke. After the working stroke no force is anymore incident on the piston 316, whereupon the piston moves back to its starting position, i.e. the piston moves back by being pushed by the pressure on the front side of the piston. In an overload situation as the force F incident on the piston increases to force $F_{OL}$ in the pressure space of the hydraulic cylinder 9, the pressure of the hydraulic fluid rises from zero to a predetermined overload pressure ($P_{OL}$), whereupon the pressure relief valve 360 opens. At this stage, the piston has advanced the distances$_{OL}$ due to compression of the hydraulic fluid. As the pressure relief valve allows hydraulic fluid through, the piston advances and has at phase c advanced the distances$_{max}$. As the overload ends, and the pressure in the pressure space 312 falls below the overload pressure, the piston 316 return sat phase d due to the compression of the hydraulic fluid left at the pressure space to a position at a distance $S_F$ from its starting position.

The inventor has noted that the undesired give made possible by the safety apparatus hereinbefore described can be reduced with a solution that is simpler and more cost-effective than the previous solution.

Figure 6:
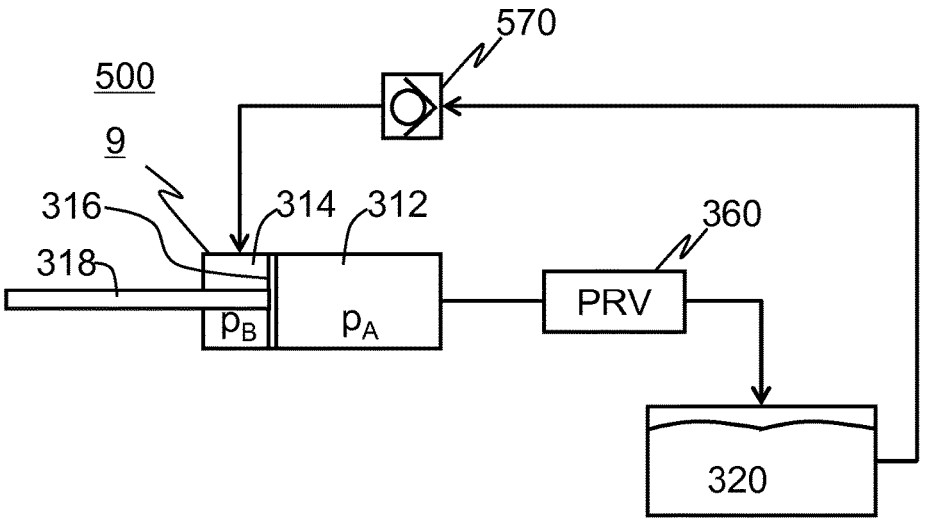
FIG. 6 shows schematically an apparatus according to the invention.

FIG. 6 shows schematically an apparatus 500 for reducing give according to an example embodiment of the invention. For reasons of clarity, some elements that have been shown with reference to FIG. 3, such as the pump 330, are not shown. Furthermore, it is to be noted that the apparatus 500 may comprise elements common to a person skilled in the art, such as means for reinstating and/or adjusting the crushing setting.

The apparatus 500 comprises a hydraulic cylinder 9. The hydraulic cylinder 9 has a piston 316 that divides the volume of the cylinder into a pressure space 312, or second space, and an opposite space 314, or first space, i.e. piston rod 318 side space. The piston rod 318 receives the load or force incident on the piston from the toggle plate. The load causes a pressure equivalent to the amount of force divided by the cross-sectional area of the cylinder into the pressure space 312. As the pressure exceeds a given pressure threshold, a pressure relief valve PRV 360 connected to the pressure space 312 allows hydraulic fluid from the pressure space to a hydraulic fluid tank 320 whereupon the toggle plate and the movable jaw are allowed to give before the excessive load. Instead of a pressure relief valve, a pressure accumulator receiving hydraulic fluid from the pressure space 312 may be used. For sake of clarity, it needs to be noted that the apparatus 500 accordingly functions as a safety apparatus that is attached or connected to the crusher jaw, or like crushing element, i.e. supports said crushing element. The piston rod side space 314 is connected to the hydraulic fluid tank 320 through valve 570. The valve 570, for example of the type of non-return valve, allows hydraulic fluid to flow from the hydraulic fluid tank 320 into the piston rod side space 314.

It is clear to a person skilled in the art that the execution of FIG. 6 is only illustrative and for example the valve 570 can be replaced with a further common element that provides the same functionality.

Figure 7:
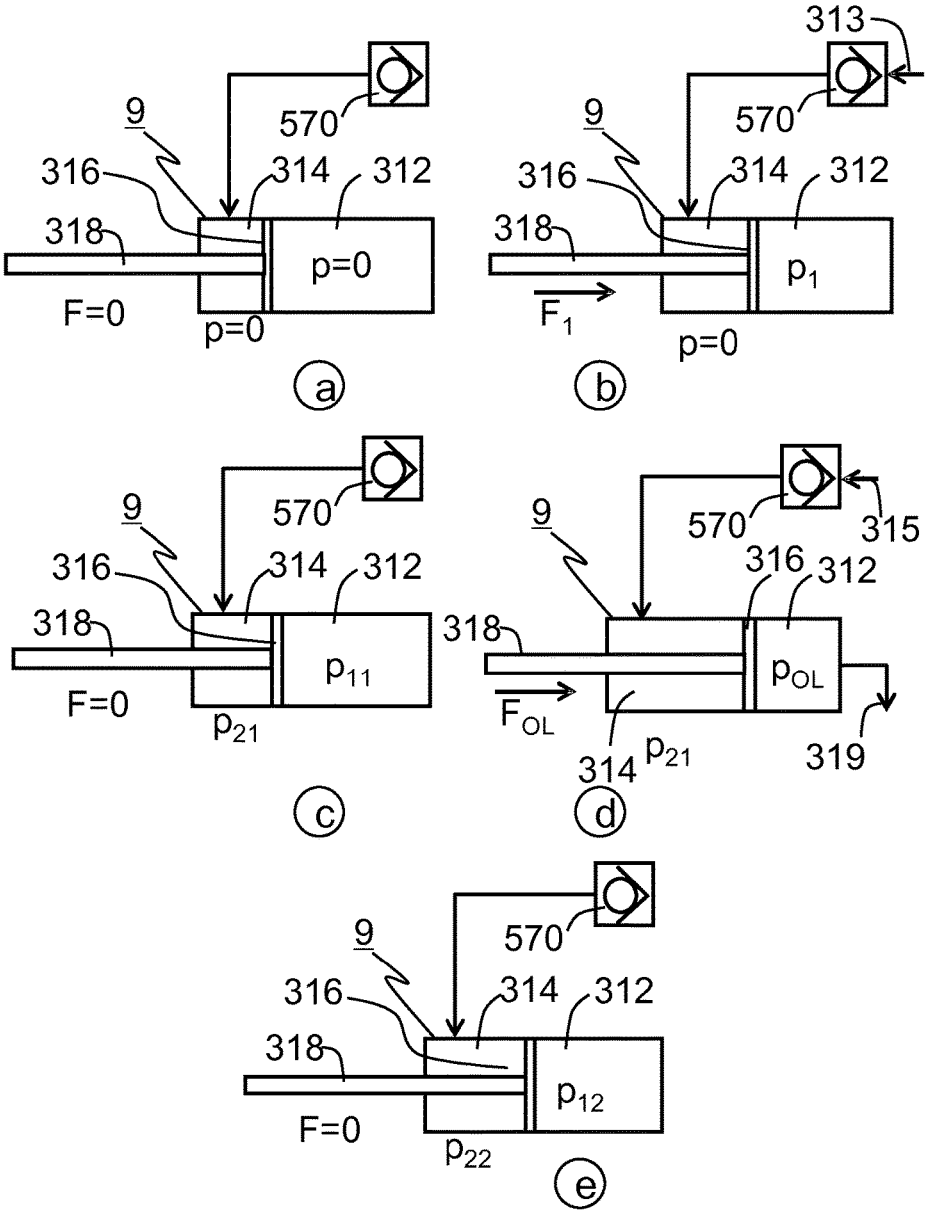
FIG. 7 shows schematically the principle of the functioning of the piston of an apparatus according to the invention during working stroke (phases a-e) and in an overload situation.
Figure 8:
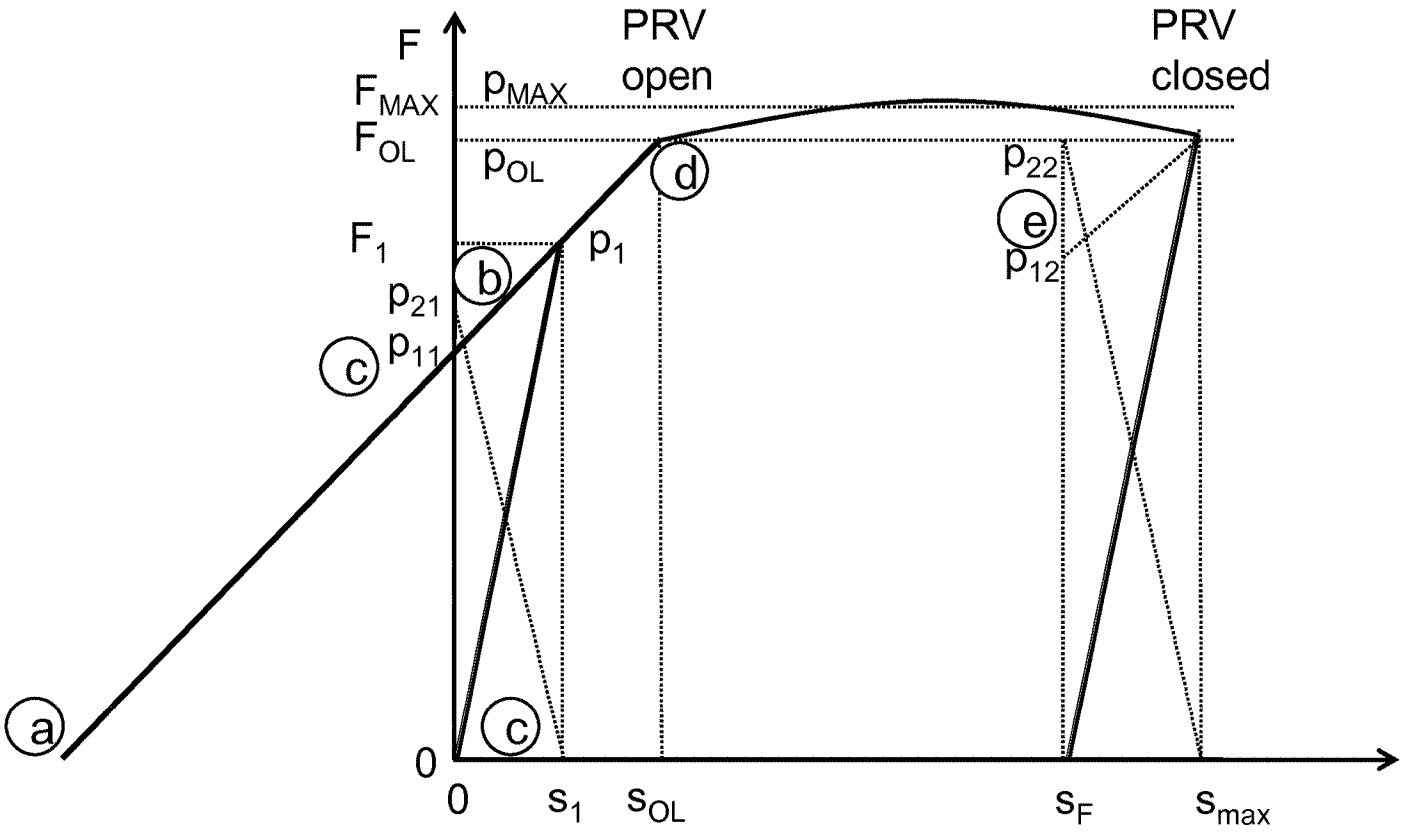
FIG. 8 shows the pressure of an apparatus according to the invention and the force caused by the pressure as a function of the position of the piston during working stroke and in an overload situation.

FIG. 7 shows schematically the principle of the functioning of the piston of an apparatus according to the invention during working stroke (phases a-e) and in an overload situation and FIG. 8 shows the pressure of an apparatus according to the invention and the force caused by the pressure as a function of the position of the piston during working stroke and in an overload situation.

At the beginning of a first working stroke of the jaws of the crusher at phase a the pressure in the pressure space 312 of the cylinder 9 is zero, since no crushing force is incident on the cylinder. During the working stroke at phase b the pressure in the cylinder rises to pressure $p_1$ that is dependent on the force $F_1$ received by the crushing elements and incident on the cylinder and on the cross-sectional area of the piston 316 of the cylinder 9. Concurrently the piston 316 being pressed by the piston rod advances a distance $s_1$ due to compression of the hydraulic fluid.

As the piston advances hydraulic fluid flows 313 from the hydraulic fluid tank 320 through valve 370 into the piston rod side space 314 of the hydraulic cylinder 9. At the end of the working stroke no force is anymore incident on the piston rod whereupon the pressure $p_1$ moves the piston 316 into the direction of the piston rod, i.e. the piston seeks to move backwards in the hydraulic cylinder 9 due to being pushed by the pressure in front of the piston. The oil that has flown into the piston rod side space 314 of the hydraulic cylinder cannot flow away whereupon at phase c the pressure in the piston rod side space 314 rises to a value $p_{21}$ and in the pressure space 312 the pressure falls to a value $p_{11}$. The distance that the piston concurrently moves is shorter than in a situation wherein there is no pressure in the piston rod side space 314. At phase c a situation according to the invention has been reached, in which situation the 0-coordinate of the graph represents a working mode of the apparatus 500 in which the amount of give has been reduced without the valve and control systems according to state of the art. During the following working strokes a pressure $p_{21}$ or a pressure larger than that prevails in the piston rod side space 314 depending on the force $F_1$ of the working strokes incident on the crushing elements and therethrough on the piston rod, whereupon the distance that the piston reciprocates is small and the undesired give is reduced. The reduction of give is manifested in FIG. 8 from which can be seen the pressure rising more steeply and the distance $s_1$ being smaller after the first working stroke than in the situation according to the state of the art depicted in FIG. 5.

The energy needed to pressurize the piston rod side space 314 of the hydraulic cylinder is taken from the working stroke, i.e. from the force incident on the crushing element, that is the movement of the piston 316 moves hydraulic fluid into the piston rod side space 314 of the hydraulic cylinder 9. The arrangement does not require complicated additional devices and is thus energy- and cost-effective. Respectively, the pressure generated into the piston rod side space 314 resists the movement of the piston on its own without complicated arrangements.

In an overload situation of a working stroke as the force $F_{OL}$ increases in the pressure space of the hydraulic cylinder 9, the pressure of the hydraulic fluid rises from the pressure $p_{11}$ to a predetermined overload pressure ($P_{OL}$), whereupon the pressure relief valve 360 opens. At this stage, the piston has advanced a distance $s_{OL}$. When the pressure relief valve allows 319 hydraulic fluid into the hydraulic fluid tank 320 and 315 into the piston rod side 314, the piston 316 advances and has at the travelled a distance $s_{max}$. As the overload ends, and the pressure in the pressure space 312 falls below the overload pressure, the pressure relief valve closes. At the end of the overload situation of a working stroke, the force incident on the piston rod falls to zero, whereupon the pressure $p_{OL}$ moves the piston 316 into the direction of the piston rod. The oil that has flown into the piston rod side space 314 of the hydraulic cylinder cannot flow away whereupon at phase e the pressure in the piston rod side space 314 rises to a value $p_{22}$ and in the pressure space 312 the pressure falls to a value $p_{12}$. The distance that the piston concurrently moves is shorter than in a situation wherein there is no pressure in the piston rod side space 314. During the following working strokes a pressure $p_{22}$ or a pressure larger than that prevails in the piston rod side space 314 depending on the force $F_1$ of the working strokes incident on the crushing elements and therethrough on the piston rod, whereupon the distance that the piston reciprocates is small and the undesired give is reduced. The reduction of give is manifested in FIG. 8 from which can be seen the pressure rising more steeply and the distance $s_F \ldots s_{max}$ being smaller after the first working stroke than in the situation according to the state of the art depicted in FIG. 5. This has the advantage that in a potential problem situation, such as in an overload situation or in situation in which an uncrushable object is in the crushing chamber, the opening SF of the crusher jaws is larger than in the known solutions due to the steeper rise angle whereupon for example uncrushable material exits the crusher chamber faster.

The setting can be returned to the one that preceded the problem situation for example by pumping a necessary amount of hydraulic fluid into the space 312. Respectively, hydraulic fluid can be diverted from space 314 into the tank 320. Preferably this can be carried out by steering the obstruction member of the valve 570, such as flap or ball, to open and allow hydraulic fluid into the tank 320.

According to an example embodiment, the give can alternatively be reduced already prior to the first working stroke by directing a force on the crushing elements for example by adjusting the steering of the crushing elements in such a way that a force is directed at the crushing elements through which, as the piston rod 318 moves, hydraulic fluid flows from the hydraulic fluid tank 320 through the valve 570 into the piston rod side space 314 of the hydraulic cylinder 9 as hereinbefore described, and the operational state in which the give is reduced to being smaller than in the state of the art is reached. According to an example embodiment, the directing of the force prior to the first working stroke can also be carried out with a separate arrangement.

Figure 9:
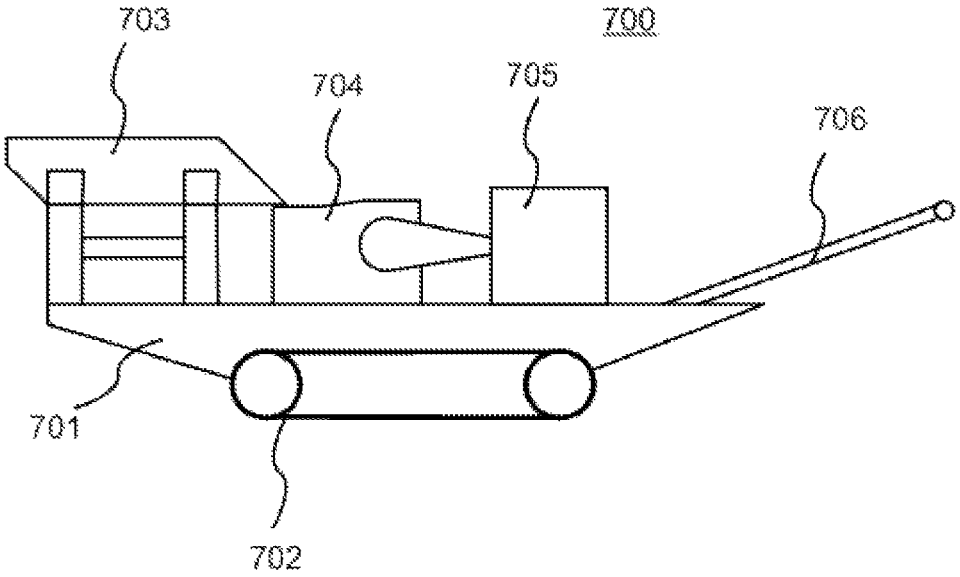
FIG. 9 shows a mineral material processing plant according to the invention.

FIG. 9 shows a mobile mineral material processing plant 700 according to the invention comprising a feeder 703 for feeding material into a crusher 704, such as into a jaw crusher or a HSI-crusher (Horizontal Shaft Impact Crusher) and a belt conveyor for conveying the crushed product further away from the processing plant. The crusher depicted in the Fig. is preferably a jaw crusher comprising an apparatus according to an embodiment of the invention for reducing give. The processing plant 700 further comprises a power source and a control centre 705. The power source may be for example a diesel or electric engine that provides energy for the process units and hydraulic circuits.

The feeder, the crusher, the power source and the conveyor are attached to a frame 701 which in this embodiment further comprises a track base 702 for moving the processing plant. The processing plant may also be completely or in part wheel-based or movable on legs. Alternatively, it may be movable or towable with for example a truck or other external power source. In addition to the hereinbefore, the processing plant may also be a fixed processing plant.

In particular in jaw crushers the planned motion path of the pendulum is known, for compensating of which a counterbalance has been designed for a fly wheel. The give causes an anomality into the motion path of the pendulum whereupon the motion path diverges from the planned one and dynamic forces that the counterbalance necessarily cannot compensate arise. Dynamic forces increase undesired vibrations to the frame of the crusher and therethrough further to the frame of the mineral material processing plant or plants. By reducing give, the vibrations caused by dynamic forces can be reduced.

Without in any way limiting the scope, interpretation or possible applications of the invention, an improvement of the energy consumption and capacity of a mineral material processing plant can be considered a technical advantage of different embodiments of the invention. Furthermore, an increased lifetime of components of a mineral material processing plant can be considered a technical advantage of different embodiments of the invention. Furthermore, an increased environmental friendliness of a mineral material processing plant can be considered a technical advantage of different embodiments of the invention.

Furthermore, an increase of operational reliability of a mineral material processing plant can be considered a technical advantage of different embodiments of the invention.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of the principles of the invention, and not in limitation thereof. Hence, the scope of the invention is only restricted by the appended claims.

The invention claimed is:

1. A crusher for crushing mineral material comprising a fixed crushing element and a movable crushing element, wherein the fixed crushing element and the movable crushing element are arranged to receive a force, the crusher further comprising:

a hydraulic cylinder and a piston in the hydraulic cylinder;

a piston rod attached to the piston and extending through a first end of the hydraulic cylinder and being in connection with the movable crushing element;

a first space inside the hydraulic cylinder behind the piston and around the part of said piston rod inside a hydraulic cylinder;

a second space inside the hydraulic cylinder and in front of the piston;

a valve;

a first hydraulic connection from said valve to said first space; wherein during operation of the crusher, when the piston moves further than previously in the hydraulic cylinder toward the second space due to the force, said valve is configured, in response only to the piston moving in the hydraulic cylinder towards the second space due to the force, to enable a flow of hydraulic fluid into said first space.

2. A crusher according to claim 1, wherein the valve is configured to prevent a flow of hydraulic fluid from said first space in response only to the piston moving in the hydraulic cylinder towards said first space.

3. A crusher according to claim 1, wherein the crusher comprises a pressure relief valve in a hydraulic connection to said second space through a second hydraulic connection.

4. A crusher according to claim 3, wherein the pressure relief valve is configured to enable a flow of hydraulic fluid from said second space in response to the pressure of the second space reaching a predetermined pressure ($p_{OL}$).

5. A crusher according to claim 1, wherein the crusher is a jaw crusher or a horizontal shaft impact (HSI) crusher.

6. A mineral material processing plant wherein the mineral material processing plant comprises a crusher according to claim 1.

7. A mineral material processing plant according to claim 6, wherein the mineral material processing plant is a mobile processing plant.

8. A method for reducing give in a crusher, the method comprising:

providing the crusher which includes a movable crushing element arranged to receive a force and an apparatus including a hydraulic cylinder, a piston, a piston rod in connection with the movable crushing element and hydraulic fluid;

supporting the movable crushing element with the apparatus; and directing the hydraulic fluid through a valve to a first space behind the piston in response only to the piston moving within the hydraulic cylinder further towards a second space in front of the cylinder than previously due to the force during operation of the crusher.

9. A method according to claim 8, wherein the hydraulic fluid is directed behind the piston on the piston rod side through the valve.

10. A method according to claim 8, wherein the hydraulic fluid is prevented from exiting behind the piston on the piston rod side in response only to the piston moving backwards by being pushed by the pressure in front of the piston in the hydraulic cylinder.

11. A method according to claim 8, wherein the hydraulic fluid is removed from in front of the piston through a pressure relief valve in response to the pressure in front of the piston exceeding a predetermined pressure ($p_{OL}$).

* * * * *